US005867165A

United States Patent [19]

Neill

[11] Patent Number: 5,867,165

[45] Date of Patent: Feb. 2, 1999

[54] DYNAMIC INFORMATION DISPLAY DEVICE

[76] Inventor: Andrew Peter Neill, 56b Long Garden Walk, Farnham, Surrey, United Kingdom, GU9 7HX

[21] Appl. No.: 596,092

[22] PCT Filed: Aug. 26, 1994

[86] PCT No.: PCT/GB94/01870

§ 371 Date: Jan. 31, 1996

§ 102(e) Date: Jan. 31, 1996

[87] PCT Pub. No.: WO95/06306

PCT Pub. Date: Mar. 2, 1995

[30] Foreign Application Priority Data

Aug. 26, 1993 [GB] United Kingdom ..... 9317795

[51] Int. Cl.[6] ..... G09F 19/00

[52] U.S. Cl. ..... 345/418

[58] Field of Search ..... 345/418, 419; 434/191, 154, 203, 258; 273/110, 112; 472/114, 116

[56] References Cited

U.S. PATENT DOCUMENTS

| | | | |
|---|---|---|---|
| 3,831,934 | 8/1974 | Hankovsky | 472/114 |
| 4,062,543 | 12/1977 | Loeffler | 273/110 |
| 4,509,920 | 4/1985 | Kaufmann | 434/159 |
| 4,993,952 | 2/1991 | Yeh | 434/191 |

FOREIGN PATENT DOCUMENTS

| | | |
|---|---|---|
| 2397030 | 2/1979 | France . |
| 1239535 | 7/1971 | United Kingdom . |
| 1601810 | 11/1981 | United Kingdom . |
| 2231808 | 11/1990 | United Kingdom . |

*Primary Examiner*—Cliff Vo

*Attorney, Agent, or Firm*—Nixon & Vanderhye P.C.

[57] ABSTRACT

A diary display and storage device of three dimensions (preferably helical) onto which visual data can be appended or a series of data units actually forming the device (helix) itself. A helically shaped device forms a compact storage unit onto which additional helical frames or units can be easily appended. The complete helical assembly can be axially mounted on bearings such that on rotation of the helix about its central axis, each data unit will appear in a sequential order in the same line.

12 Claims, 4 Drawing Sheets

DYNAMIC INFORMATION DISPLAY DEVICE

This invention relates to a device for the storage and display of visually represented information whereby visual information units are stored/displayed compactly in a consecutive manner and according to the sequence in which the information occurs. In a preferred embodiment consecutive items of such information can be made to appear sequentially at the same location. Additional information units can be appended in a simple, compact and infinite fashion.

The invention can be applied to any application whereby data items need to be stored consecutively i.e. in such a way where the order of the data items is important. For example, an ornithologist may want to keep a record of the first species of bird he sees each morning and record that bird species each day. A simple diary may be adequate for this purpose. If various trends need to be assessed then it would be desirable that each of the data items are presented next to each other in a chronological fashion. If one wanted to scan a whole year then this would entail having to flick through each page which is cumbersome. A yearly calender however, would enable all data items to be viewed at a glance. However in order to view a trend it is necessary to carefully follow each day in a chronological order, a requirement which requires the viewer to scan back and forth along the months, arranged in columns or rows, something which is liable to cause confusion and eye-strain of the viewer. An alternative is to use a long strip of paper. This can be impracticable if a large amount of visual data need to be stored consecutively.

Molecular models exist in the art whereby units representing atoms may be connected to form molecules. Although these may form any shape, the appended units represent a specified set of data i.e. atoms and do not represent any visual data. In addition these models do not represent chronologically ordered data.

Borruso, in UK patent specification GB 1239535 describes a three dimensional model of the periodic classification of elements, which is in the form of a helix. The purpose of this is as an instructional aid to display molecular relationships between the elements which are arranged in a predefined order. The helix can be made from a coil of paper. This patent however does not cater for continual increase in the amount of data to be stored, and in any case is made up from a set of predetermined units. The specification does not teach that the user that he can append data according to his choice.

Frames exist such a printing presses or abacuses type arrangements onto which data may be appended. These limit the data storage and display to linear or rather flat forms.

The invention overcomes these problems by allowing visual data to be arranged in a sequential order in any combination according to the sequence in which it occurs by means of a frame of three-dimensional shape or configuration onto which visual data may be appended, or by visual units having such shape that they connect to form a three-dimensional shape or configuration.

According to the invention is provided a diary device for the display and storage of visual data comprising a three dimensional body in which visual data are and/or may be incorporated in the form of identifiable visual data units.

The invention may comprise either a frame onto which data units can be appended, or be made up of sequential units which can be connected to form a certain shape or morphology. The information units could be located such that they form a snake pattern, a spiral a circle or even be flexible. The device may have the dual purpose of being a necklace or bracelet also.

In the most preferred embodiment of the invention the visual sequential data is stored and displayed as a helix or spiral (hereinafter both referred jointly as helix). This has technical advantages in that information can be stored and displayed very compactly and the helical form can be extended indefinately fairly simply.

In addition, a further technical advantage of having the data arranged as a helix, means that rotation of the helix about its central axis means that each visual data unit will appear in the same location or rather horizontal axis i.e. in consecutive order in the same horizontal line.

The invention will now be explained in detail with reference to the following diagrams by means of example only.

Figure 1:
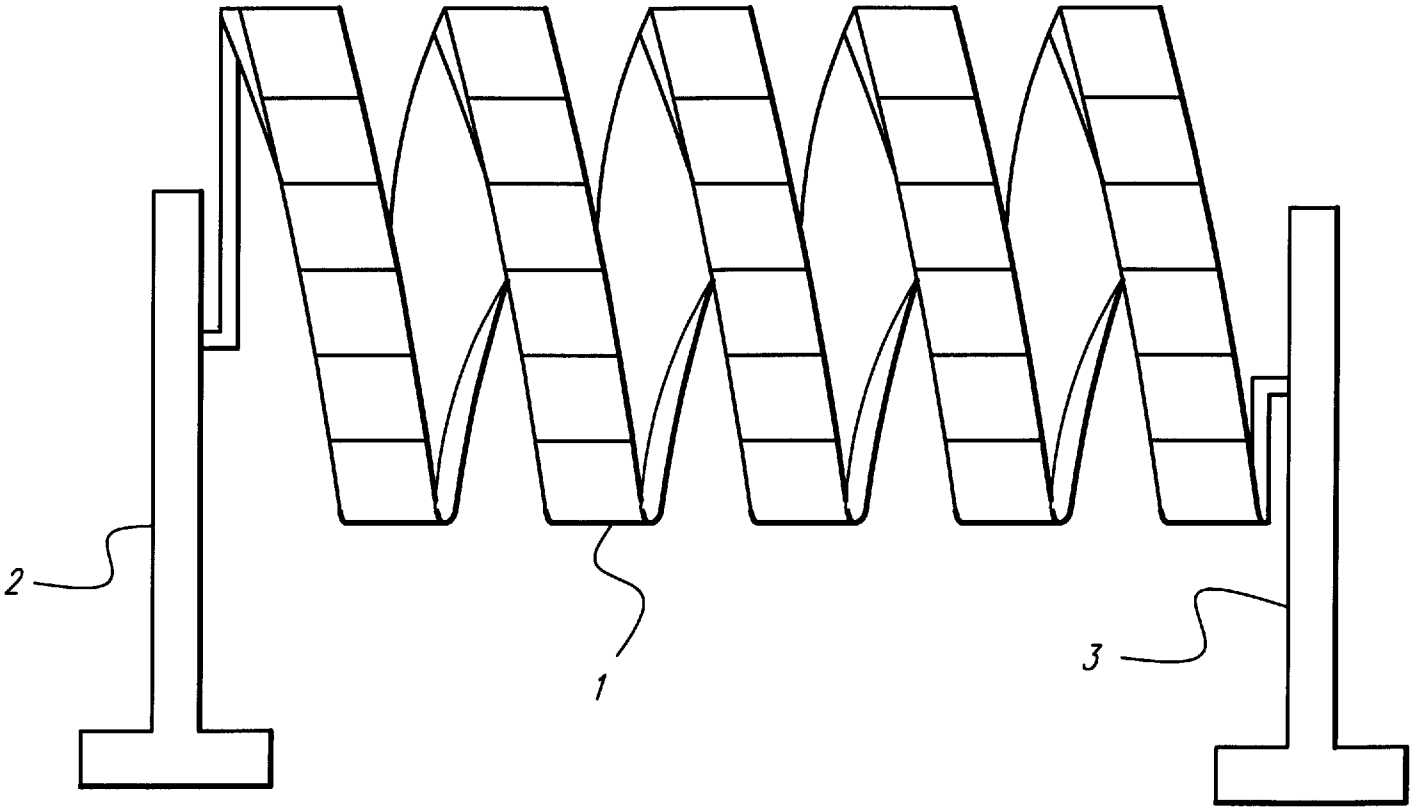
FIG. 1 shows one embodiment of the invention comprising a helical frame and support at both ends.

FIG. 1 shows a frame 1 fabricated from a clear plastic material. The frame is helical in shape and may comprise any number of helical turns. The helical frame is supported at both ends by supports 2, 3 which additionally enable the helical frame to be rotated about it's central axis.

Figure 2:
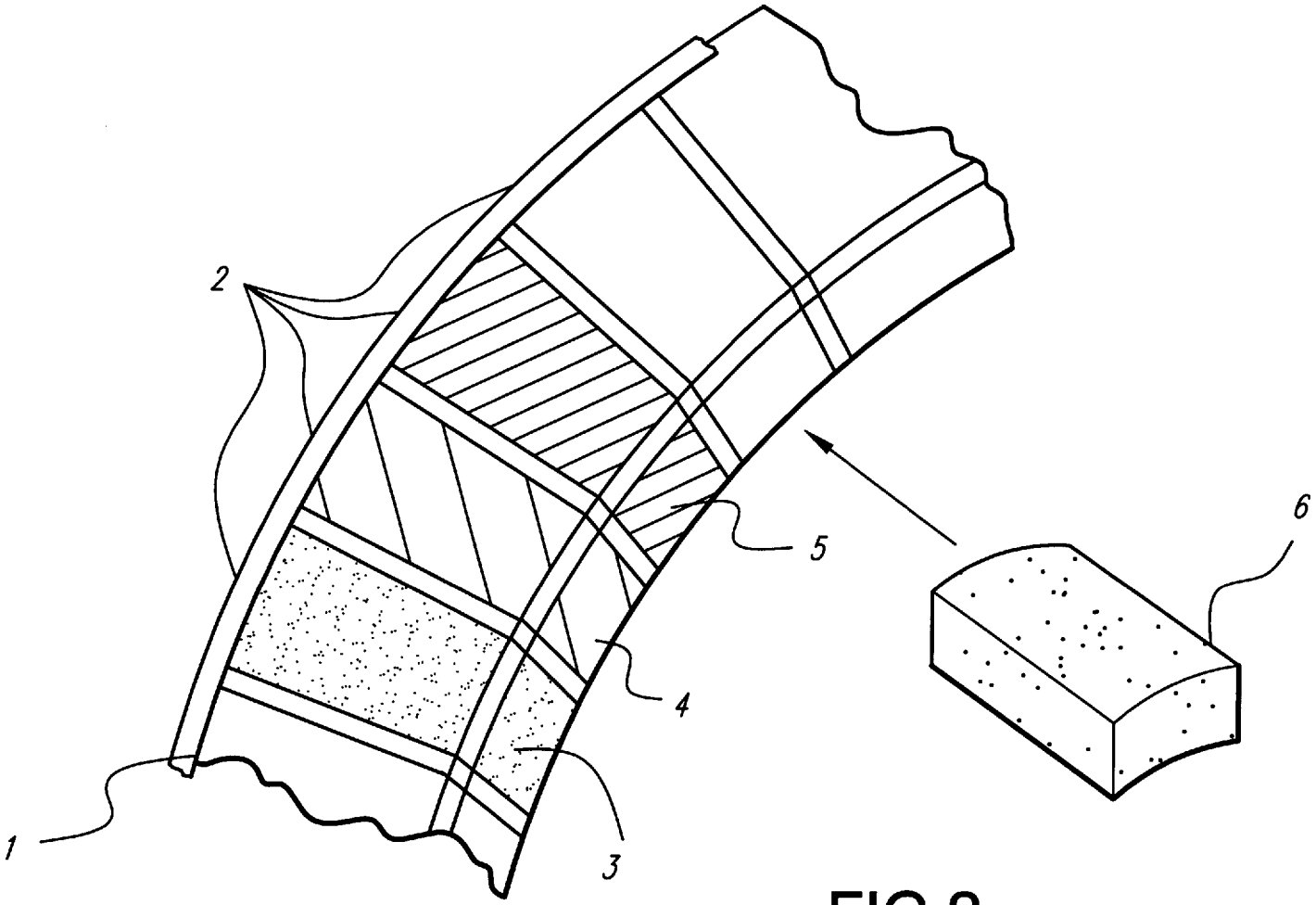
FIG. 2 shows a close up view of a section of the helical frame of FIG. 1 which shows how information blocks may be appended.

FIG. 2 shows in further detail a section of the frame 1. The frame comprises consecutive adjacent receptacles for receiving blocks which can be inserted into the receptacles. Preferably these blocks are such that they are permanently fixed into said frame such that they cannot be removed once inserted. These blocks represent information units; in this embodiment the blocks are coloured, each colour representing a different piece of information, and these blocks may be inserted into or onto said frame, via adjacent receptacles. For example, each colour may signify a different event taking place on a certain day. Alternatively each colour may correspond to certain human emotions or feelings. Thus a black block may represent a bad day or week, an orange block may represent a happy day or week, a grey block a particularly dull day or week, a white block a non-descriptive day or week, and a green block a week or day in the country. In this way, after each day or week, a coloured block is inserted into the next space in the frame. In the embodiment shown four blocks are shown located in the frame. Block 3 represents the users feeling on a Tuesday, which the user has assigned a "black day". Hence a black block has been inserted into the frame. Block 4 was inserted into the frame at the end of Wednesday and was chosen by the user to be a "red" day. This was inserted therefore into the frame adjacent to block 1. Thursday was designated a green day by the user and therefore block 5 which is green was inserted into the next position i.e. adjacent to block 4. The appropriately coloured block for Friday, block 6 which is a yellow block, is shown freely and is to be inserted into receptacle adjacent to the green block shown by the arrow. In this manner consecutive chronological blocks are inserted into adjacent positions of the frame, and after such time a helical array of units is built up. The frame may consist of helices having any number of turns. Additionally in order to extend data storage the apparatus may be extended indefinitely by having the frames designed so that they can interlock with each other so as to form a continuous helix.

For example each frame may consist of a helix having 4 turns, each frame being able to accommodate 48 data units i.e. 12 data units per frame. If two frame are connected together in a continuous manner the helix will then comprise of 8 turns and is able to accommodate a total of 96 data units. The size of the apparatus can thus be extended indefinitely by linking additional frames.

Figure 3:
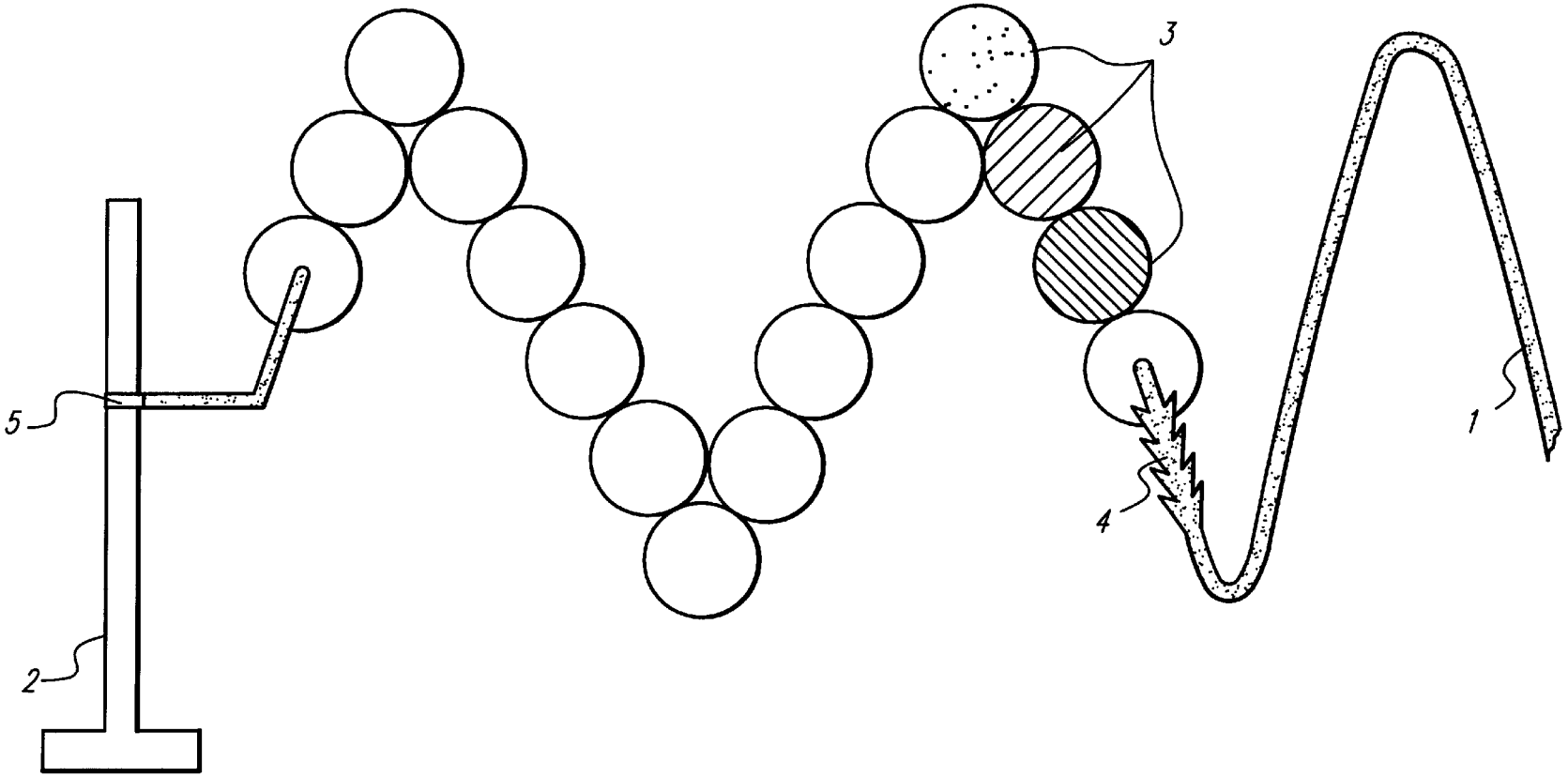
FIG. 3 shows an alternative embodiment of the invention comprising a helical wire frame supported at both ends.

FIG. 3 shows an alternative embodiment of the invention. The frame 1 comprises simply of a helically wound wire. The frame is supported at both ends by supports, only one of which, 2, is shown because FIG. 3 only shows a half view. It should be clear that the remainder view comprises the rest of the helical frame along with the second support. The helical supports comprise means such that the helical frame can rotate about it's central axis. Data units comprise of beads, 3 having holes drilled in them. The beads which are different colours are simply threaded onto the helical frame in a consecutive manner. The hole in the beads may be interfaced with the wire in such a way that movement of the beads is restricted once it is pushed into position. For example in the embodiment shown the wire is made of a resilient material having unidirectional barbs 4, such that beads can only be moved in one direction. The said barbs restricting the movement of beads in one direction. At both ends of said frame the wire is bent such that wire extents outwards from said frame parallel with the axis of said formed helix and concentrically located to it. At both ends are provided supports each of which possess a journal 5 bearing into which the wire may be inserted. The wire frame can be inserted into the the support such that it is free to rotate along its longitudinal axis.

Figure 4:
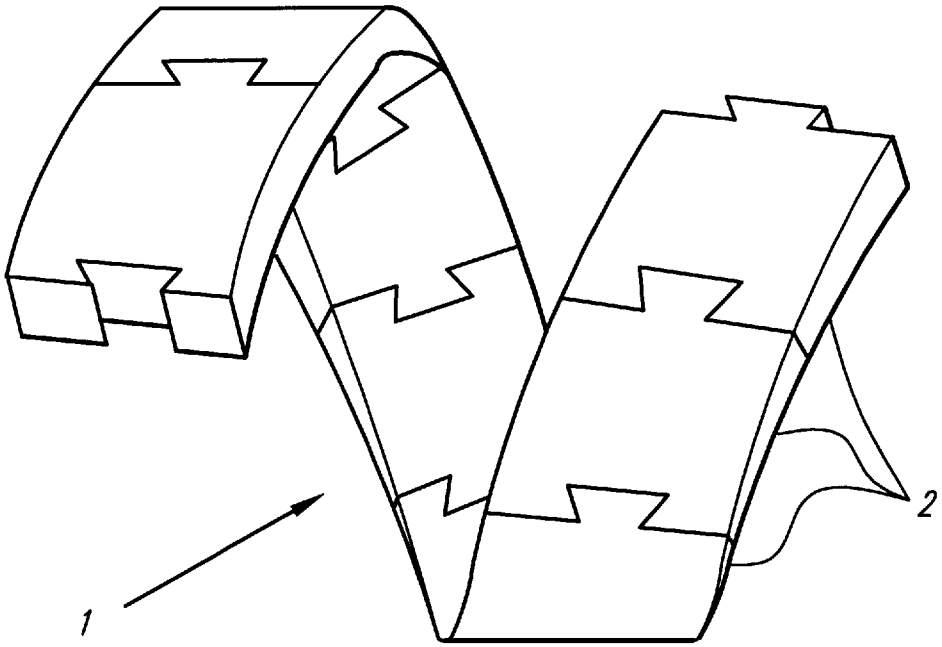
FIG. 4 shows another embodiment of the invention wherein a helix is formed solely from individual data units.

FIG. 4 shows a third embodiment of the invention. This embodiment is quite different from the previous two embodiment in that there is no frame. Instead a helix 1 is comprised wholly of data units 2. The data units are shown in more detail in FIG. 5. Each data unit is designed such that they can be linked to one another and to form a helix. In the present described embodiment each data unit has dovetail 3 at one end and an identical dovetail shaped slot 4 at the other end. One data unit can be connected to the next data unit by mating the dovetail at one end of a data unit with the dovetail recess at one end of the next data item. Data units are thus connected by dovetail joints. Each data unit is shaped such that it forms a fraction of a spiral.

Figure 5A:
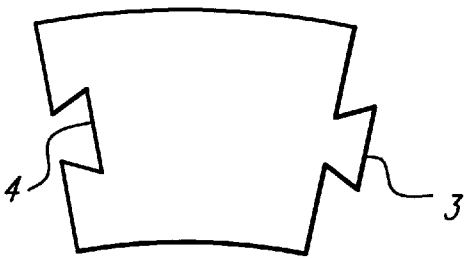
FIG. 5 shows in detail a plan (5*a*) and side view (5*b*) of a data unit according to the embodiment of FIG. 4.
Figure 5B:
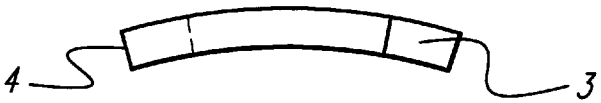

FIGS. 5*a* and 5*b* show respectively a plan view and side view of a data unit according to the above embodiment in detail. The data unit is shaped such that it is a portion of a helix.

In the embodiments described the information units comprise coloured units, representing human events or emotions. It would be clear however to a person skilled in the art that data units may comprise information in any visual or visual form. The information blocks may for example have letters of the alphabet formed on them, each letter of the alphabet representing a different piece of information. Alternatively, the information units may have pictorial information on them. For example the blocks may contain pictures of different species of bird. In another example an angler may wish to represent the species of fish he angles for each weekend by sequentially connecting units having pictorial representations of those species fished for. The invention could have use in medical diagnosis. Each visual unit may represent in some form the temperature of a patient, or the well being/degree of illness of the patient according to some predefined scale standard.

Alternatively frames or units may be left blank and the user could be provided with a sheet of adhesive labels or transfers having visual or pictorial representations of data on them. These can then be appended onto the frame or unit.

It would be clear to a person skilled in the art that instead using coloured information units, visual information may simply be appended by painting a series of coloured rings e.g. around a helical frame. Or alternatively, pictorial information may be painted onto the frame.

I claim:

1. A diary device for the display and storage of visual data comprising:

a helical three dimensional frame for displaying said visual data in the form of identifiable visual data units; and supports for mounting said helical three dimensional frame for rotation about an axis of rotation.

2. A diary device for the display and storage of visual data as claimed in claim 1 wherein said visual data is appended to said frame.

3. A diary device for the display and storage of visual data, as claimed in claim 2 wherein said frame comprises a hollow or recessed frame for receiving visual data units.

4. A diary device for the display and storage of visual data, as claimed in claim 1 wherein said frame comprises a helical wire and said data units comprise drilled beads.

5. A diary device for the display and storage of visual data, as claimed in claim 2 comprising means for preventing removal of the data units once located into position.

6. A diary device for the display and storage of visual data, as claimed in claim 1 wherein said helical frame additionally comprises means whereby further helical frames can be connected to form a continuous helix.

7. A diary device for the display and storage of visual data as claimed in claim 1 whereby said frame comprises one or more visual data units connected so as to form said frame.

8. A diary device for the display and storage of visual data as claimed in claim 7, wherein said visual data unit is the form of a helix or fraction thereof.

9. A diary device for the display and storage of visual data as claimed in claim 8 wherein said visual data units can be joined together to form a continuous uninterrupted helix.

10. A diary device for the display and storage of visual data as claimed in claims 7, whereby said visual data units have connections so as to be able to connect with each other.

11. A diary device for the display and storage of visual data as claimed in claim 8 further including means for rotating said helical assembly about its central axis.

12. A diary device for the recordal and display of temporally spaced events comprising a plurality of three dimensional subunits each adapted to display a characteristic of the event wherein their position in the device is indicative of the temporal order of the event.

* * * * *